US006318006B1

(12) United States Patent
Hall

(10) Patent No.: US 6,318,006 B1
(45) Date of Patent: Nov. 20, 2001

(54) PUSHER TRENCHER

(76) Inventor: Ronald H. Hall, 168 Argyle Street, Embro, Ontario (CA), N0J 1J0

( * ) Notice: Subject to any disclaimer, the term of this patent is extended or adjusted under 35 U.S.C. 154(b) by 0 days.

(21) Appl. No.: 09/685,217

(22) Filed: Oct. 11, 2000

(51) Int. Cl.[7] ..... F16L 1/00
(52) U.S. Cl. ..... 37/367; 172/681
(58) Field of Search ..... 172/681; 37/380, 37/367, 366, 347; 405/180, 182, 174

(56) References Cited

U.S. PATENT DOCUMENTS

| | | | | |
|---|---|---|---|---|
| 3,746,100 | | 7/1973 | Hall et al. . | |
| 4,140,425 | | 2/1979 | Flippin . | |
| 4,164,982 | | 8/1979 | Draney . | |
| 4,397,585 | | 8/1983 | Fouss et al. . | |
| 4,629,363 | | 12/1986 | Rose et al. . | |
| 4,867,607 | | 9/1989 | Johnson et al. . | |
| 4,892,155 | | 1/1990 | Wanamaker . | |
| 5,090,141 | | 2/1992 | Hall . | |
| 5,108,229 | | 4/1992 | Slanker . | |
| 5,119,888 | | 6/1992 | Hall . | |
| 5,190,409 | | 3/1993 | Hall . | |
| 5,247,743 | * | 9/1993 | Holloway et al. | 37/355 |
| 5,459,952 | | 10/1995 | Tillaart et al. . | |
| 5,482,121 | | 1/1996 | Draney et al. . | |
| 5,496,135 | | 3/1996 | Penix . | |
| 5,497,568 | * | 3/1996 | Strickland | 37/348 |
| 5,526,590 | | 6/1996 | Palm et al. . | |
| 5,529,131 | | 6/1996 | Van Ornum . | |
| 5,743,675 | | 4/1998 | Fluharty et al. . | |
| 5,827,013 | | 10/1998 | Fluharty et al. . | |
| 5,934,147 | * | 8/1999 | Parker | 74/490.05 |
| 6,056,067 | | 5/2000 | Brown . | |

* cited by examiner

*Primary Examiner*—Christopher J. Novosad
(74) *Attorney, Agent, or Firm*—R. Craig Armstrong

(57) ABSTRACT

A plow trenching apparatus for a vehicle having a raisable boom structure, for example a skid steer vehicle. The apparatus comprises a tool attached to a tool mounting plate of the boom structure. The tool has an arm mounting plate, attachable to the tool mounting plate, a J-shaped curved arm having an arm mount arranged at one end and a plow holder mount arranged at the other end, a plow holder attachable to the plow holder mount, the plow holder mount permitting the plow holder to pivot horizontally, a plow attachable to the plow holder, and a hydraulic cylinder. The arm mount is attachable to the arm mounting plate via an arm pivot attachment. The curved arm is horizontally pivotable at the arm mount by the hydraulic cylinder. The hydraulic cylinder is extendable and retractable and attached to the arm mounting plate via a hydraulic cylinder attachment and attached to the curved arm via an arm pivoting attachment arranged on the curved arm.

11 Claims, 11 Drawing Sheets

6
6''
6'
9
9'
7'''
7'
8

6
7'''
7'
8
9
7'

6
6''
7'''
7'
8
α
β
9
9'

6
6'
9

PUSHER TRENCHER

BACKGROUND OF THE INVENTION

1. Field of the Invention

The invention relates to a plow trenching apparatus for tools attached to a carrier vehicle, such as a mini tractor of the skid steer type. Examples of tools are drainage tubing plows or cable laying plows, i.e. tools used for laying tubing or cable in one operation (without having to dig a trench, lay the tubing/cable and then fill the trench). More specifically, the trenching apparatus makes it possible to perform trenching operations with a mini tractor by pushing the tool, i.e. the mini tractor travelling in a forward direction.

2. Description of the Prior Art

In the past, different approaches have been tried to perform the trenching and cable/pipe laying operations in one operation. Cable plow equipment is shown in, for example, U.S. Pat. Nos. 5,496,135, 3,746,100, 5,482,121, 4,164,982, 4,140,425, 4,867,607, 5,743,675, 5,108,229, 5,827,013, 4,397,585, 4,629,363 and 5,190,409. A common characteristic of all the devices shown in these documents is that the tool is either permanently attached to a vehicle or attached to the rear of a vehicle, and both types are pulled behind the vehicle. This means that either the vehicle is backing up during operation, if the tool is attached to the front of the vehicle, or the tool is attached to a special tool holder arranged at the rear of the vehicle. In both instances, the vehicle operator has problems viewing either the ground in front of the vehicle or the tool during its plowing action.

An especially beneficial arrangement of an adjustable blade holder is shown in U.S. Pat. No. 5,090,141. The plow is held in a holder which is pivotably arranged on arms attached to a vehicle. The plow is movable in the vertical direction with regard to the holder using, for example, a hydraulic cylinder. In this way, the position of the plow blade can be adjusted relative the holder to effectively change the depth of the plow cut in the soil.

A trenching plow having replaceable tip wear components is shown in U.S. Pat. No. 5,119,888.

Small skid steer loader vehicles are known and used where a lightweight and compact vehicle is necessary. The loader arms of this type of vehicle have a tool mount for accepting different types of tools, for example scraper blades, as shown in U.S. Pat. No. 5,529,131, or a trench vibratory compactor, as shown in U.S. Pat. No. 5,526,590. Neither of these implements are suitable for plow cable/pipe laying.

SUMMARY OF THE INVENTION

It is an object of the invention to provide a plow cable/pipe laying apparatus, which is suitable for mounting on and operating with a skid steer loader vehicle.

A further object of the invention is to provide a plow cable/pipe laying apparatus, which is suitable for operating with a skid steer loader vehicle travelling in its forward direction having the plow cable/pipe laying apparatus attached to the loader arms of the vehicle, thus pushing the plow of the apparatus.

It is a still further object of the invention to provide a plow cable/pipe laying apparatus, which is suitable for operating with a skid steer loader vehicle travelling in its backing up direction having the plow cable/pipe laying apparatus attached to the loader arms of the vehicle, thus pulling the plow of the apparatus, using the same apparatus as for pushing the plow, but pivoted 180 degrees.

Yet a further object of the invention is to provide a plow cable/pipe laying apparatus, which allows the individual adjustment of the plow blade in the vertical direction.

Another object of the invention is to provide a plow cable/pipe laying apparatus, which has a vibration means for vibrating the plow during operation of the apparatus.

In the invention, a plow trenching apparatus for a vehicle is described. The vehicle has a raisable boom structure at a front area thereof, and is for example a skid steer vehicle. The vehicle has a forward driving direction and a backward driving direction.

The plow trenching apparatus has an arm with a proximal end pivotally mounted to the boom structure to extend forwardly and sidewardly relative to the vehicle. A trenching plow is pivotally mounted at a distal end of the arm, to the end rearwardly and downwardly therefrom. The plow is preferably mounted to a plow mount via a plow pivot means at the distal end. A biasing means is mounted between the arm and the boom structure, the biasing means being extendable and retractable to thereby control the position of the trenching plow relative to the vehicle.

The plow is preferably attachable to a tool mount of the boom structure, the arm having an arm mount at the proximal end. The arm mount is attachable to the tool mount via an arm pivot means, the biasing means being attached to the tool mount via a biasing means attachment means and attached to the arm via an arm pivoting attachment arranged on the arm.

The arm thus extends forwards and sideways, with respect to a forward driving direction of the vehicle, from the arm mount.

The arm is preferably a curved arm. Examples of arm shapes are a substantially J-shaped curved arm, with the free end of the curved portion of the J forming the distal end, a substantially L-shaped curved arm, with the free end of the short shank of the L forming the distal end, a substantially U-shaped curved arm, with the cross-bar arranged at the distal end and a substantially V-shaped curved arm, with the joining of the shanks forming the distal end.

Alternatively, a substantially straight arm may be used.

The arm mount advantageously mounts to the tool mount via a tool mount coupler, and the biasing means attachment means is advantageously arranged on the tool mount coupler.

Advantageously, the plow is held by a plow holder attachable to the distal end, the plow holder permitting the plow to pivot horizontally.

The plow holder preferably comprises a plow pivot means attachable to the plow holder mount for permitting the plow holder to pivot horizontally, and a plow mounting means attachable to the plow pivot means, the plow being attachable to the plow mounting means.

A vibration means is advantageously attachable to the plow, to provide ground penetration enhancing vibrations to the plow.

To dampen vibrations travelling from the plow to the arm, an elastic element is advantageously arranged between the plow pivot means and the distal end of the arm, alternatively between the arm mount and the tool mount.

When using a J-shaped arm, the curved arm preferably has a first straight part, a second straight part and a third straight part, and the first straight part is arranged at a first angle to the second straight part, and the second straight part is arranged at a second angle to the third straight part, the arm mount being arranged at a free end of the first straight part and the plow being arranged at a free end of the third straight part.

BRIEF DESCRIPTION OF THE DRAWINGS

In order that the invention may be more clearly understood, the preferred embodiment thereof will now be described in detail by way of example, with reference to the accompanying drawings, in which.

DETAILED DESCRIPTION OF THE INVENTION

Figure 1:
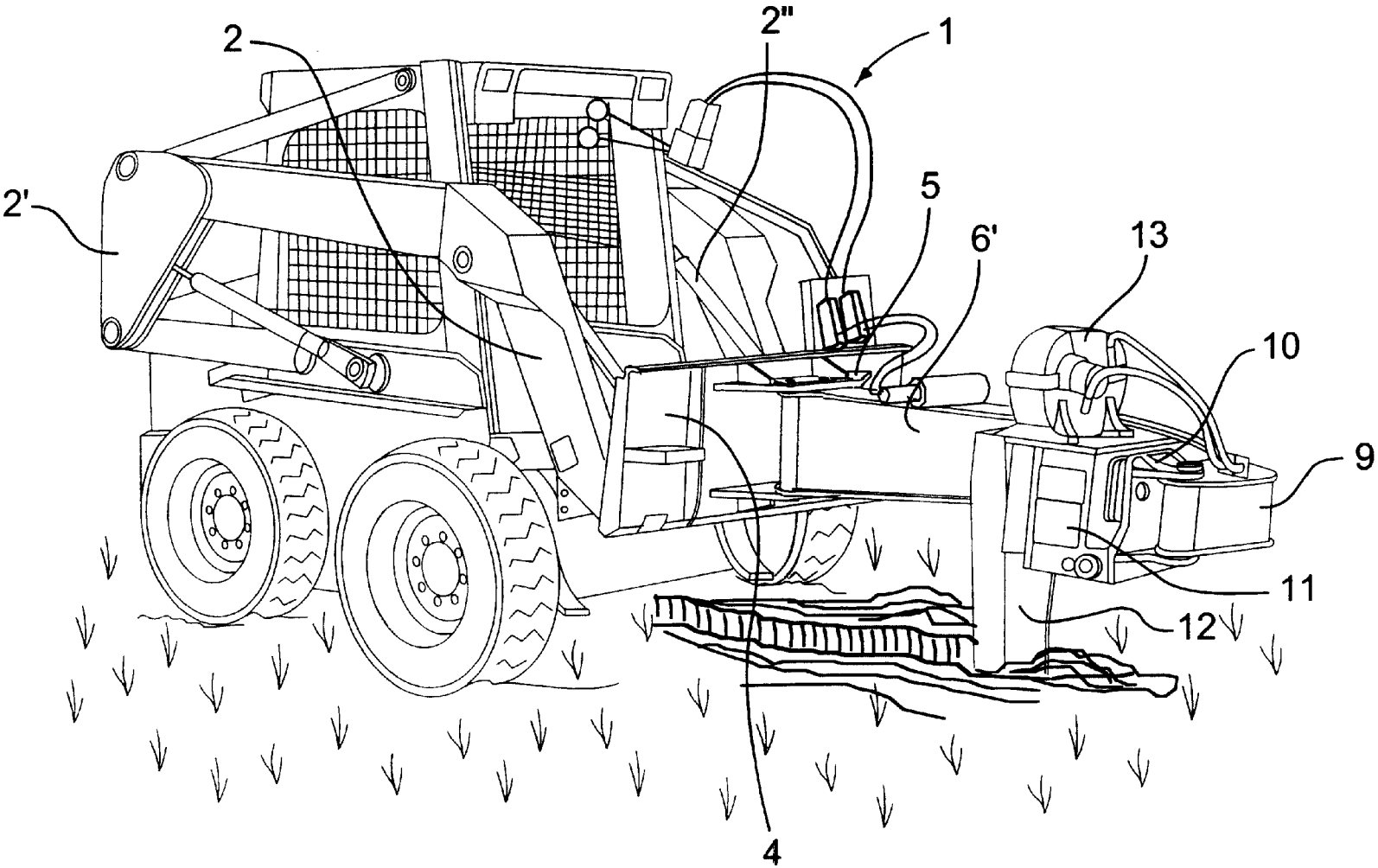
FIG. 1 is a perspective side view of a vehicle having a tool arrangement according to the invention, attached to the vehicle, showing the plow inserted into the ground during forward operation.
Figure 2:
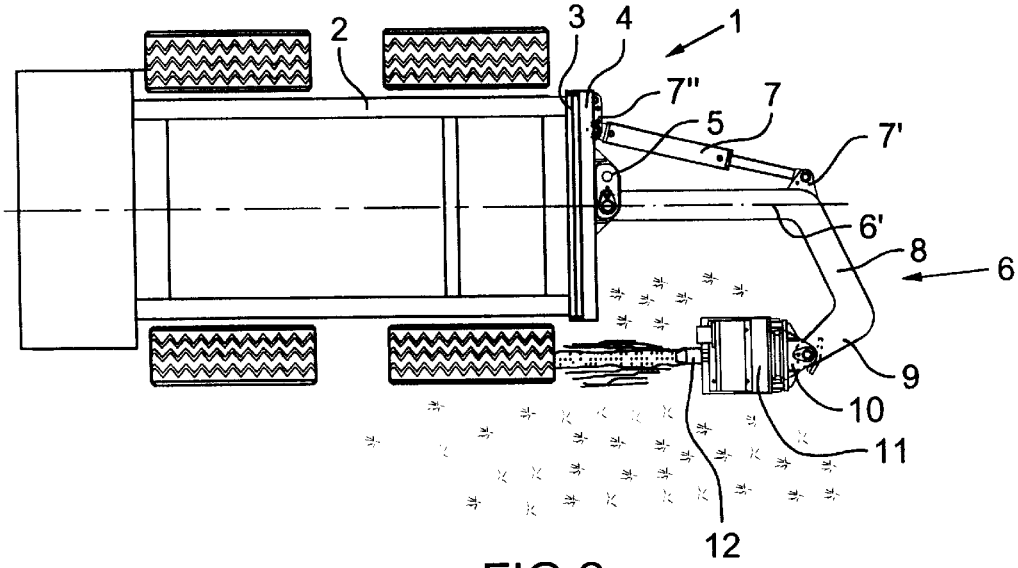
FIG. 2 is a top view of the vehicle of FIG. 1, showing the tool arranged to one side of the vehicle.
Figure 3:
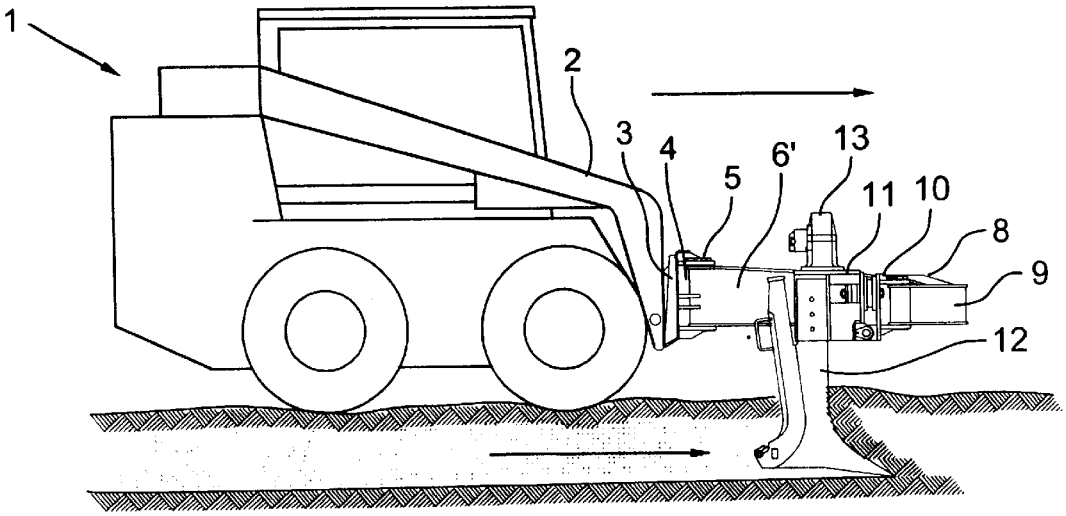
FIG. 3 is a side view of the vehicle of FIG. 1.
Figure 4:
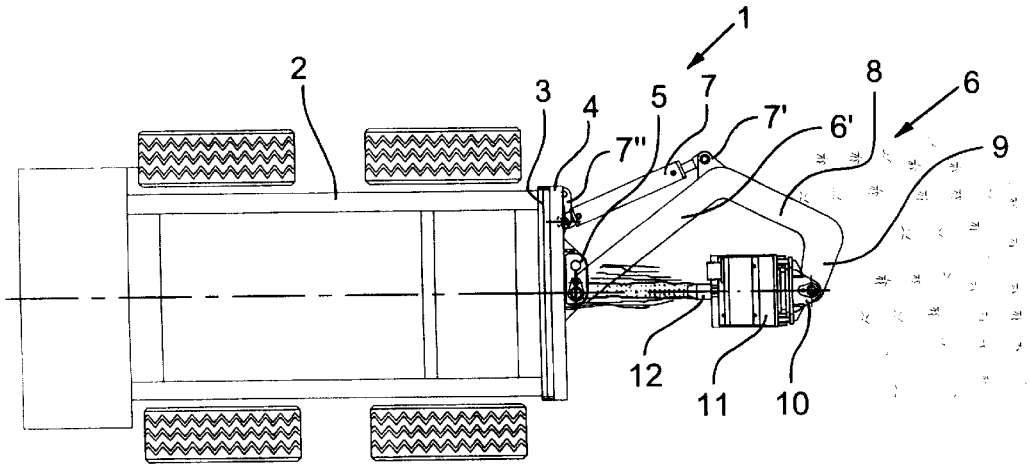
FIG. 4 is a top view of the vehicle of FIG. 1, showing the tool arranged substantially in the middle of the vehicle.

FIGS. 1 to 4 show a vehicle 1, for example a skid steer tractor or mini-tractor, having a raisable boom structure 2, which is raisable using a lifting mechanism 2'. The boom structure has a tool mounting plate 3 arranged at the liftable end thereof, the mounting plate being adapted to receive a plurality of different tools, one at the time. The tool mounting plate is usually pivotable about a horizontal axis using a tool mounting plate pivoting mechanism 2". Examples of tools mountable on the tool mounting plate are tube/cable laying plows, grader blades, trench compacting wheels and snow plows. The tool according to the invention has a curved arm 6, with a first straight part 6', a second straight part 8 and a third straight part 9. As is shown in more detail in FIGS. 20 to 23, the first straight part 6' and the second straight part 8 are arranged at a first angle $\alpha$ to each other, and the second straight part and the third straight part 9 are arranged at a second angle $\beta$ to each other. The arm 6, when viewed from above, has the general shape of a "J", with an arm mount 6" arranged at the free end of the first straight part 6', for cooperation with an arm pivot means 5 arranged on an arm mounting plate 4.

The arm mounting plate 4 is removably mountable on the tool mounting plate 3. Further, an arm pivoting attachment 7' is arranged at an outside of the bend between the first straight part and the second straight part, and a plow pivot means mount 9' is arranged at the free end of the third straight part 9. The arm mount 6" of the arm 6 is thus attached to the arm mounting plate 4, which in turn is attached to the tool mounting plate 3. The arm pivoting attachment 7' has first biasing means mounting holes 7'".

The tool further has a plow pivot means 10, which is pivotably arranged in the plow pivot means mount 9', and a plow mounting means 11, which is mountable on the plow pivot means. A plow 12, for example a cable/tube laying plow, is attachable to the plow mounting means, preferably so that the distance between a working end of the plow and the plow mounting means is adjustable. The tool further advantageously has a vibrating unit 13 arranged adjacent or on the plow, for imparting vibrations to the plow to enhance the soil cutting properties of the tool.

The arm pivoting attachment 7' is connected to a biasing means attachment means 7" arranged on the arm mounting plate 4 via a biasing means 7, advantageously a hydraulic cylinder. By extending or extracting the biasing means, the curved arm 6 can be pivoted in the desired direction relative the arm pivot means 5.

Figure 6:
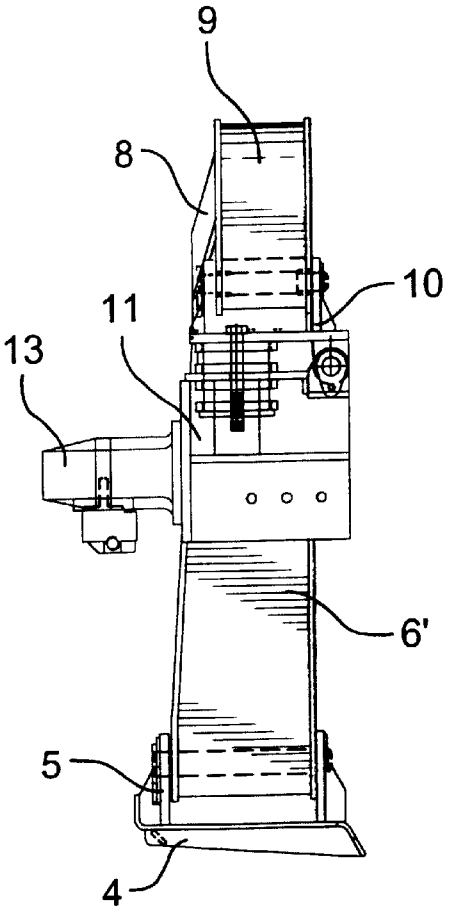
FIG. 6 is a side view of the tool arrangement of FIG. 5.
Figure 5:
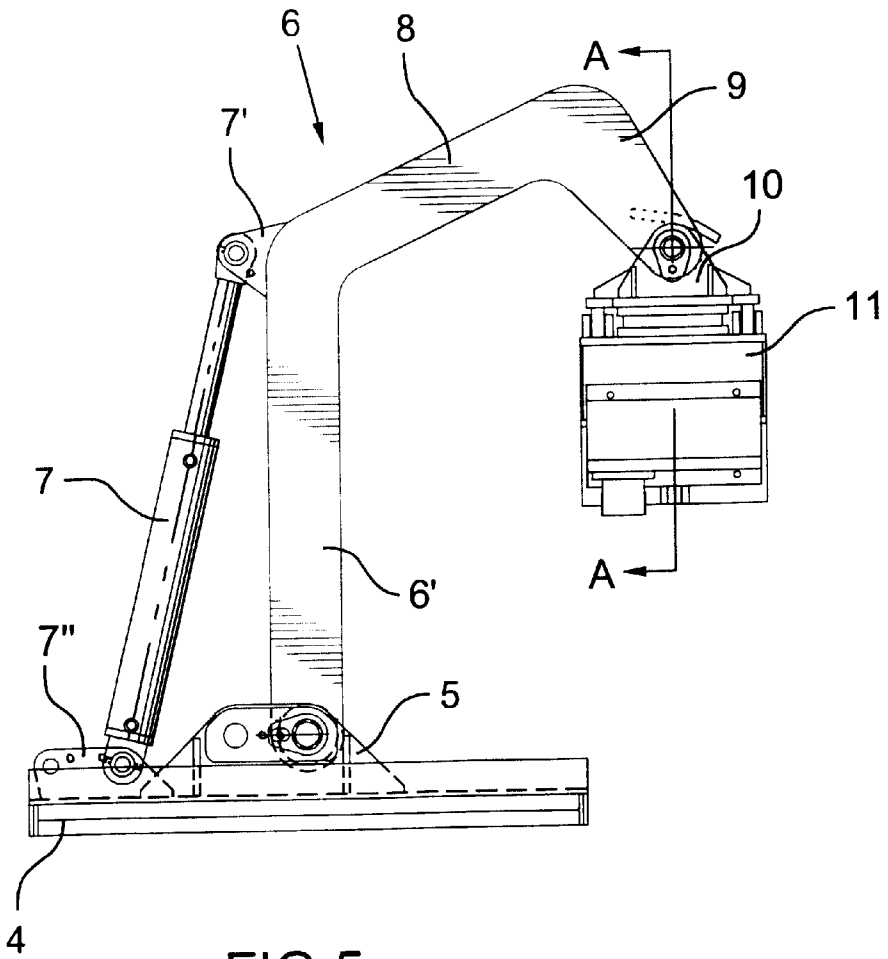
FIG. 5 is a top view of the tool arrangement of FIG. 2.
Figure 7:
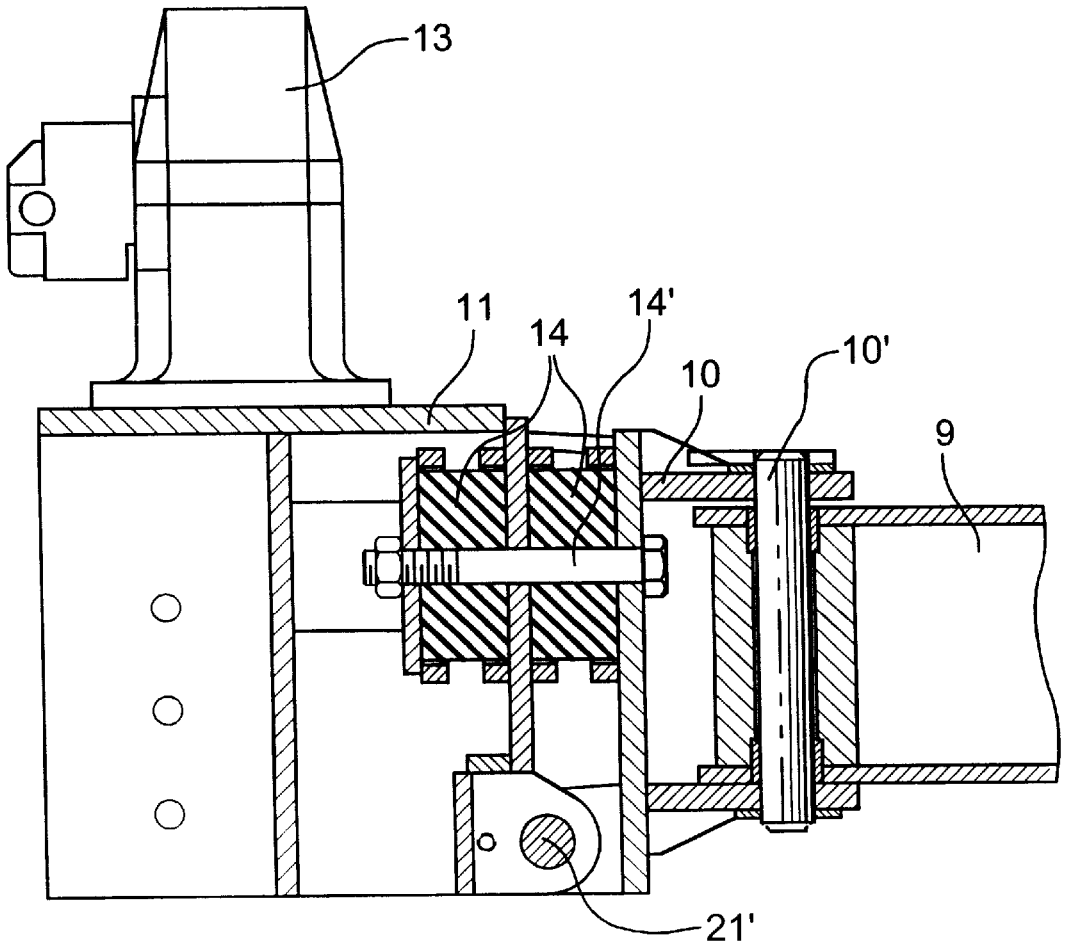
FIG. 7 is a view along section line A—A of FIG. 5.
Figure 9:
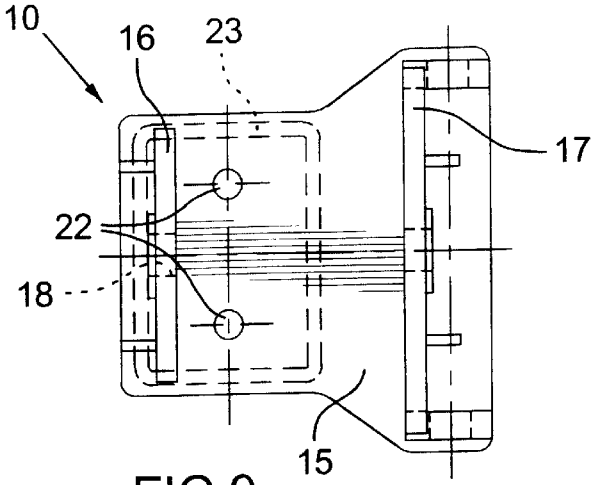
FIG. 9 is a front view of the plow pivot means of FIG. 8.
Figure 11:
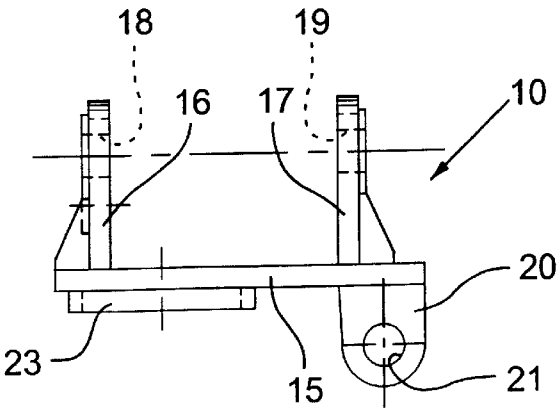
FIG. 11 is a side view of the plow pivot means of FIG. 8.
Figure 8:
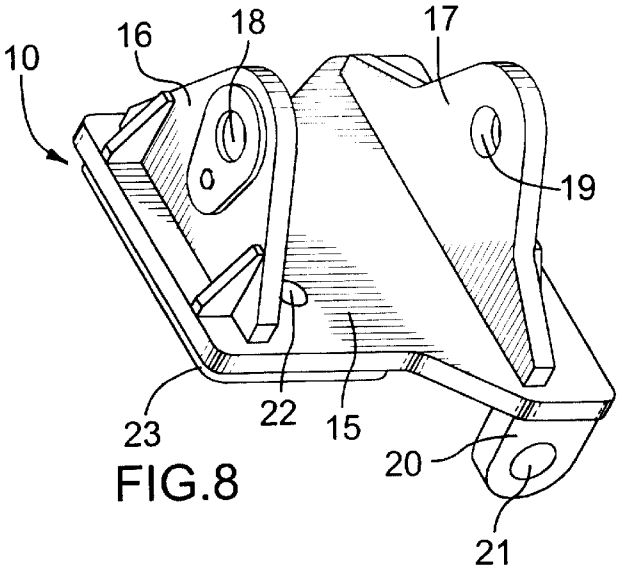
FIG. 8 is a perspective side view of a plow pivot means according to the invention.
Figure 10:
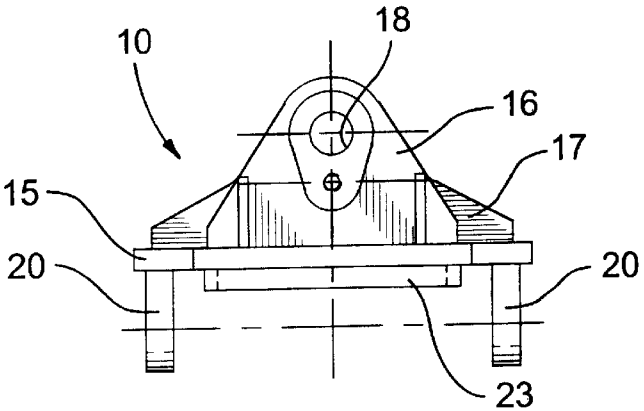
FIG. 10 is a top view of the plow pivot means of FIG. 8.
Figure 13:
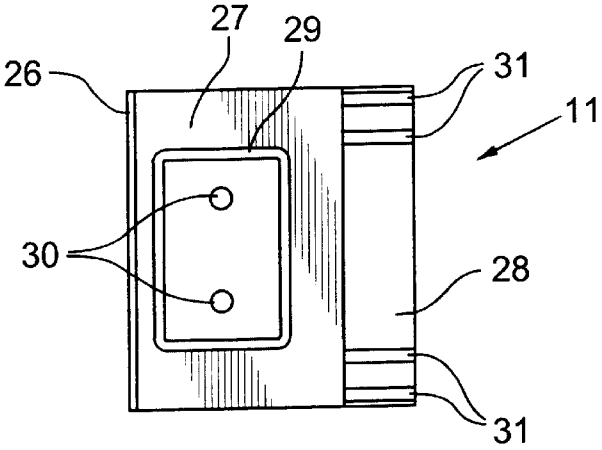
FIG. 13 is a front view of the plow mounting means of FIG. 12.
Figure 15:
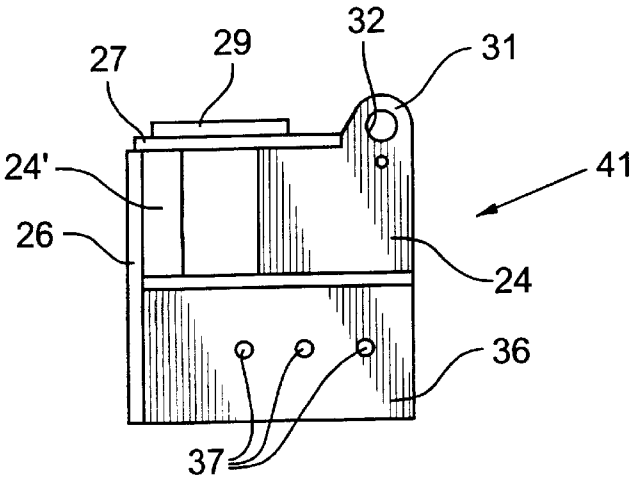
FIG. 15 is a side view of the plow mounting means of FIG. 12.
Figure 12:
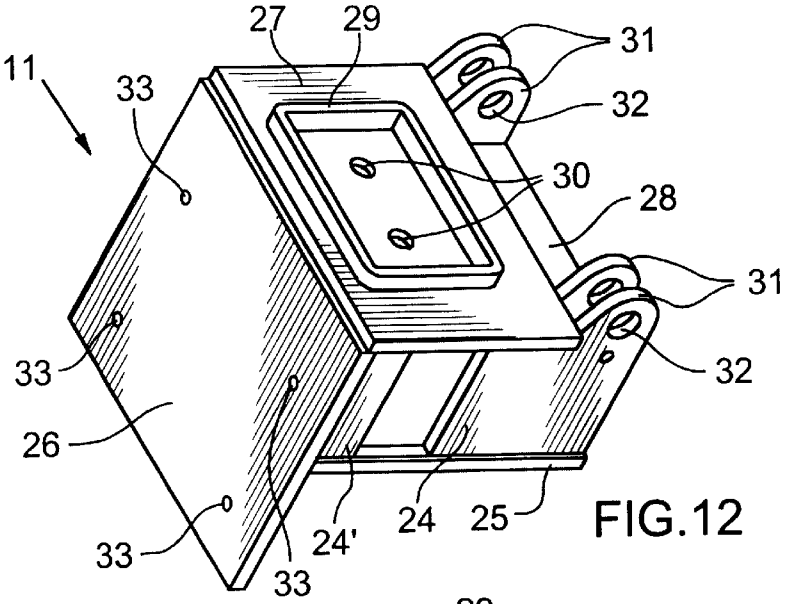
FIG. 12 is a perspective side view of a plow mounting means according to the invention.
Figure 14:
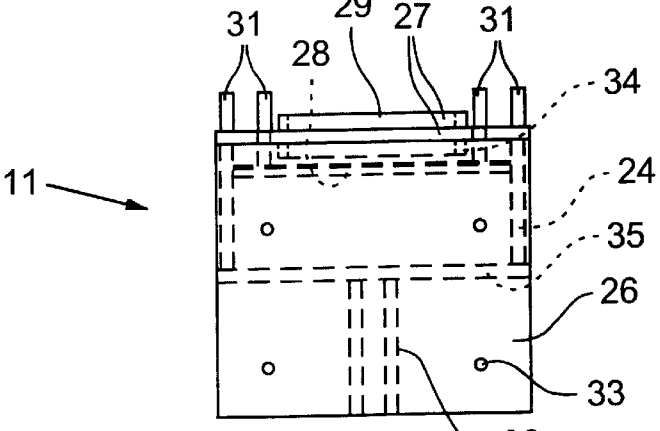
FIG. 14 is a partially sectioned top view of the plow mounting means of FIG. 12.
Figure 17:
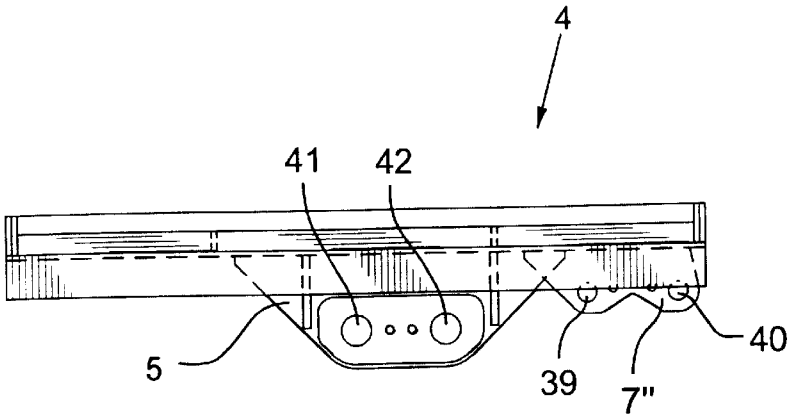
FIG. 17 is a top view of the vehicle attachment arm mounting means of FIG. 16.
Figure 19:
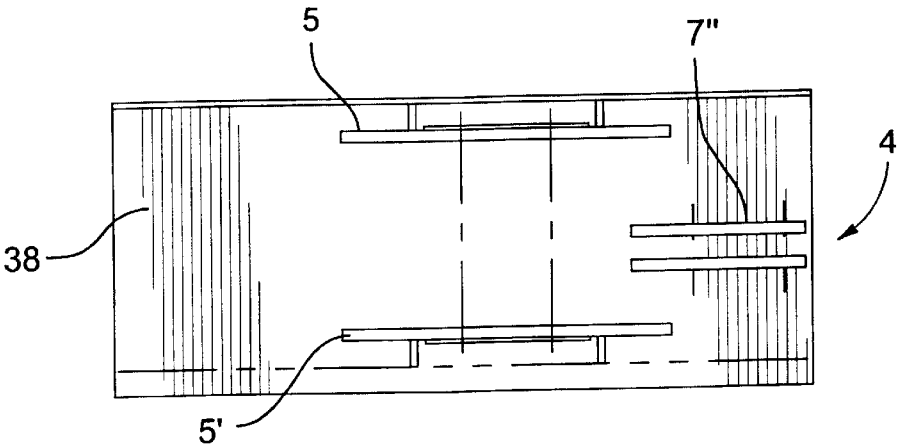
FIG. 19 is a front view of the vehicle attachment arm mounting means of FIG. 16.
Figure 16:
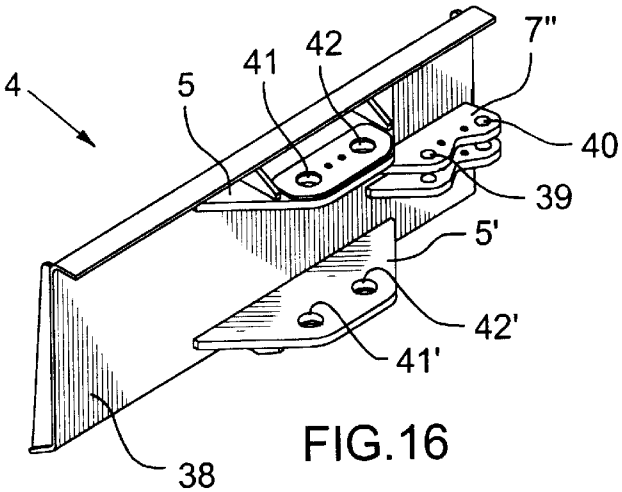
FIG. 16 is a perspective side view of a vehicle attachment arm mounting means according to the invention.
Figure 18:
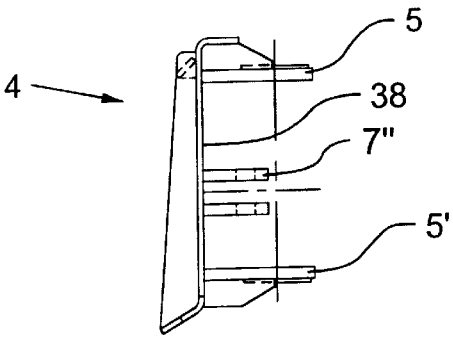
FIG. 18 is a side view of the vehicle attachment arm mounting means of FIG. 16.
Figures 20, 21, 22, 23:
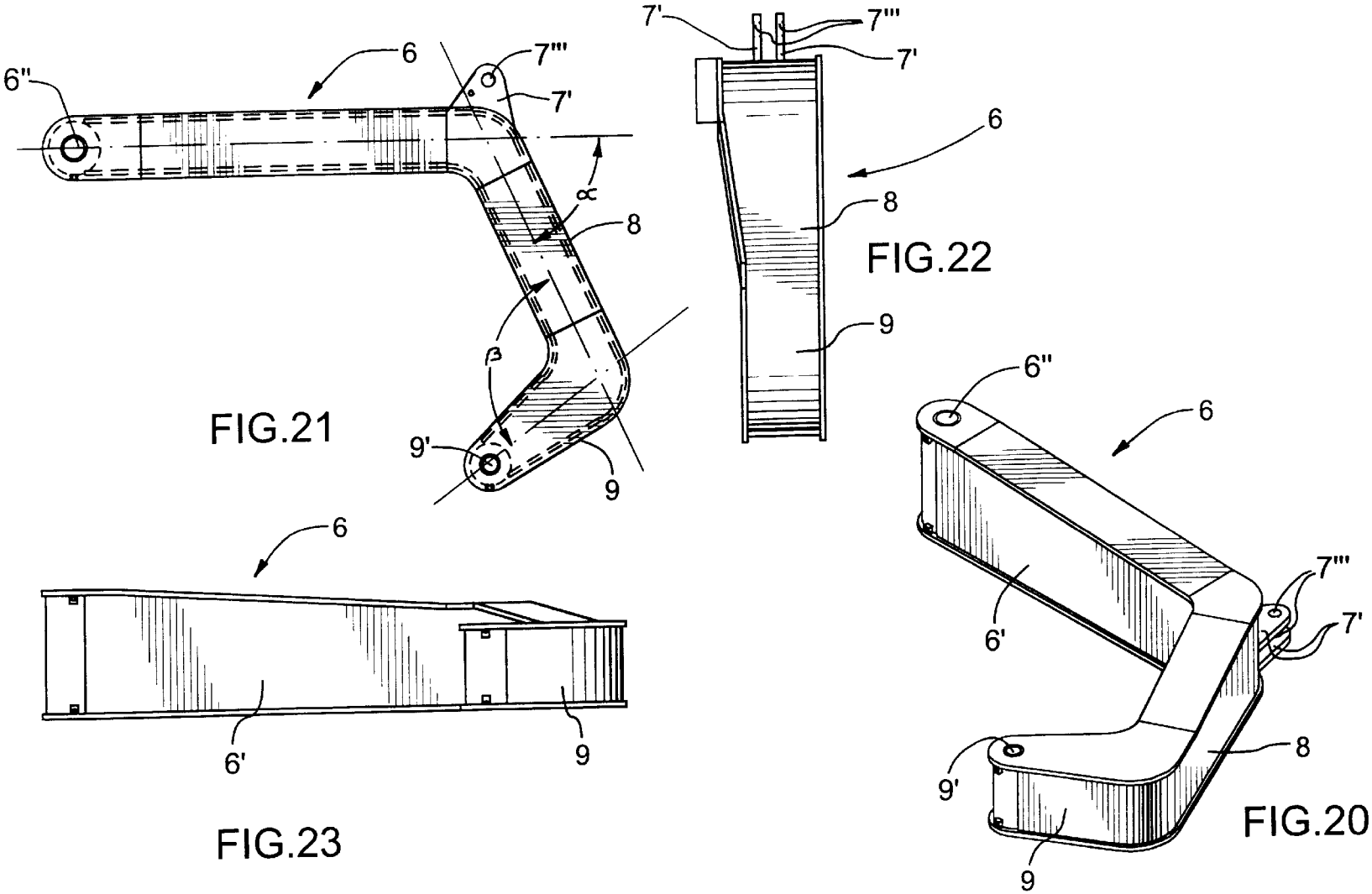
FIG. 20 is a perspective side view of a tool arm according to the invention.
FIG. 21 is a top view of the tool arm of FIG. 20.
FIG. 22 is a front view of the tool arm of FIG. 20.
FIG. 23 is a side view of the tool arm of FIG. 20.

FIGS. 5 to 7 show the layout of the tool according to the invention, where FIG. 7 is a view along section A—A of FIG. 5. In FIG. 7 is apparent the preferred mounting technique of attaching the plow mounting means 11 to the plow pivot means 10, by utilising elastic members arranged between the plow mounting means and the plow pivot means, to absorb a substantial portion of any vibrations otherwise transmitted to the curved arm 6. The elastic members are preferably rubber blocks having a through hole to admit a mounting bolt 14' or similar to be used to securely fasten the plow mounting means to the plow pivot means.

FIGS. 8 to 11 show the plow pivot means 10 in more detail. The plow pivot means preferably has a base plate 15 on which a first pivot fastening means 16 and a second pivot fastening means 17 are arranged on one side of the base plate. The pivot axle 10' (see FIG. 7) is accommodated by the first and second pivot fastening means. Further, plow mounting means attachment means 20 are arranged on the opposite side of the base plate 15. The plow mounting means attachment means have first mounting holes 21 for cooperating with mounting means on the plow mounting means (will be described later). A first elastic means holding means 23, preferably a protruding frame arranged on the same side of the base plate as the first plow mounting means attachment means, cooperate with the elastic members mounting bolts 14' and first bolt holes 22 arranged on the base plate 15 to hold the elastic members in place. The mounting of the plow pivot means 10 to the plow mounting means 11 will be described in further detail later.

FIGS. 12 to 15 show the plow mounting means 11 in more detail. The plow mounting means preferably has a back plate 27 with a second elastic means holding means 29 arranged on the side of the back plate which faces the plow pivot means 10 when the tool is assembled. The second elastic means holding means 29, preferably a protruding frame arranged cooperate with the elastic members mounting bolts 14' and second bolt holes 30 arranged on the back plate 27 to hold the elastic members in place, between the plow mounting means 11 and the plow pivot means. Further, first side plates 24 and second side plates 24' are attached to the back plate substantially perpendicularly, and stretch away from the side of the back plate 27 having the elastic means holding means 29. Preferably, a gap is arranged between the first and second side plates in order to facilitate the manipulation of and improve the access to the fastening bolts 14'. The side plates are advantageously fastened together using an end brace 25, arranged at the end of the side plates. The first side plates 24 are preferably fastened together using a cross-plate 28, for enhanced rigidity.

Further, the first side plates have plow pivoting means attachment means 31 arranged on the opposite side of the first side plate compared to where the end brace is arranged. The plow pivoting means attachment means have second mounting holes 32 for cooperating with the first mounting holes 21 on the plow pivoting means 10, for example using pins 21'. In this way, the plow mounting means can pivot slightly around the pins because of the elastic properties of the elastic members 14. This enhances the vibration dampening capabilities of the construction.

Abutting the back plate 27 and the second side plates 24', a top plate 26 is preferably arranged to hold the vibration means 13, or other equipment. Equipment mounting holes 33 are arranged in the top plate for this purpose.

FIGS. 16 to 19 show the arm mounting plate 4 in more detail. The arm mounting plate preferably has an elongate shape with a first surface 38 facing away from the vehicle it is intended to be mounted on. On the first surface, the arm pivot means 5 and the biasing means attachment means 7" are arranged. To allow alternate mounting points for the curved arm 6 on the arm pivot means, a first curved arm mounting hole 41 and a second curved arm mounting hole 42 are provided in the arm pivot means. Naturally, more than two holes may be provided. Also, only one hole is within the scope of the invention, if no adjustment of the curved arm pivot position will be necessary. Similarly, a first biasing means mounting hole 39 and a second biasing means mounting hole 40 may be provided in the biasing means attachment means 7", to allow for adjustments in the angle of the biasing means relative the curved arm 6. Again, more than two holes may be provided. Also, only one hole is within the scope of the invention, if no adjustment of the biasing means angle will be necessary.

Figure 24:
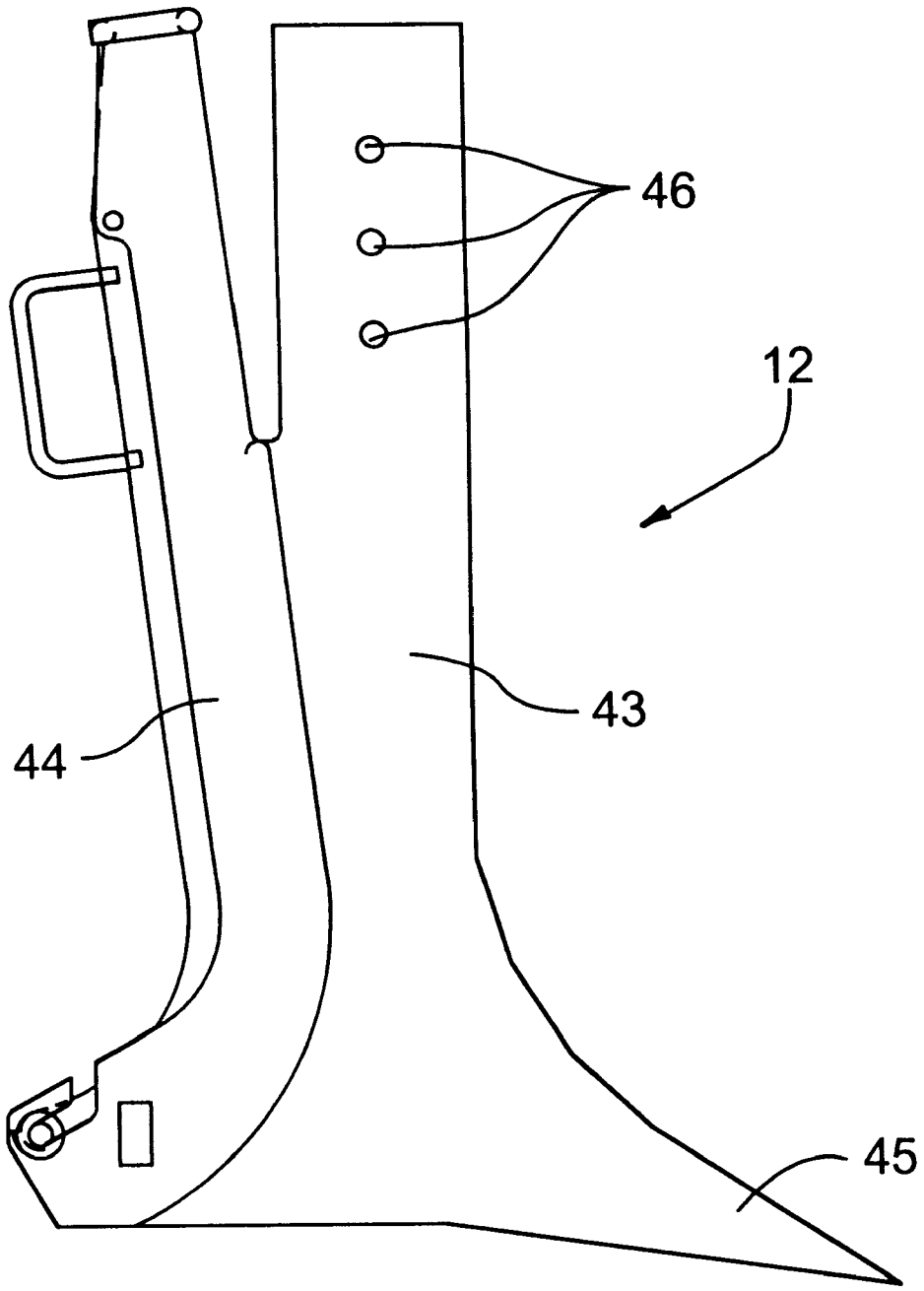
FIG. 24 is a side view of a plow tool according to one embodiment of the invention.

FIG. 24 shows a preferred embodiment of the plow 12 used in the invention. The plow has a main shaft 43, a cable/tube channel 44 arranged at the rear of the plow (with the front being the side which is facing the travel direction of the plow), a working end 45 (the tip of the plow) and a plurality of plow mounting holes 46.

Figure 25:
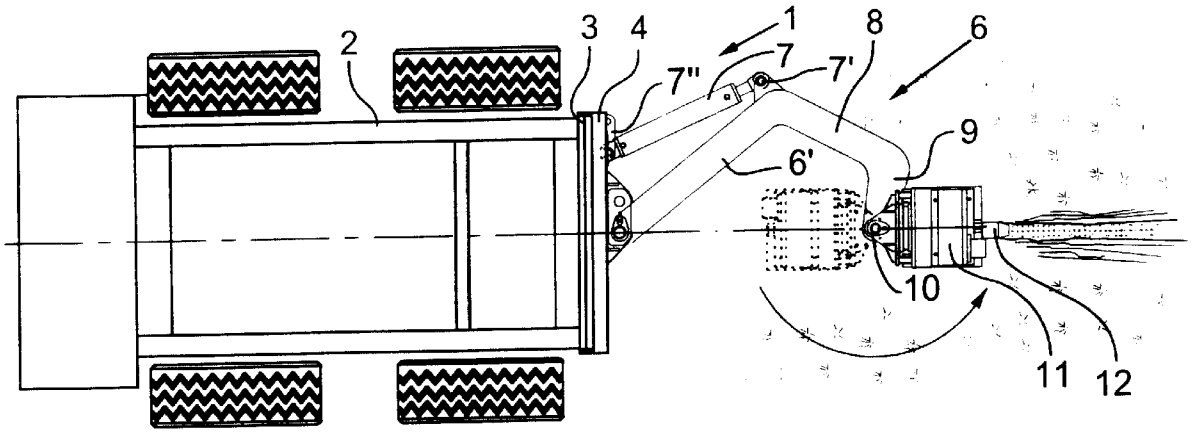
FIG. 25 is a top view of the vehicle of FIG. 1, showing the tool arranged for operation with the vehicle travelling in a rearward direction.
Figure 26:
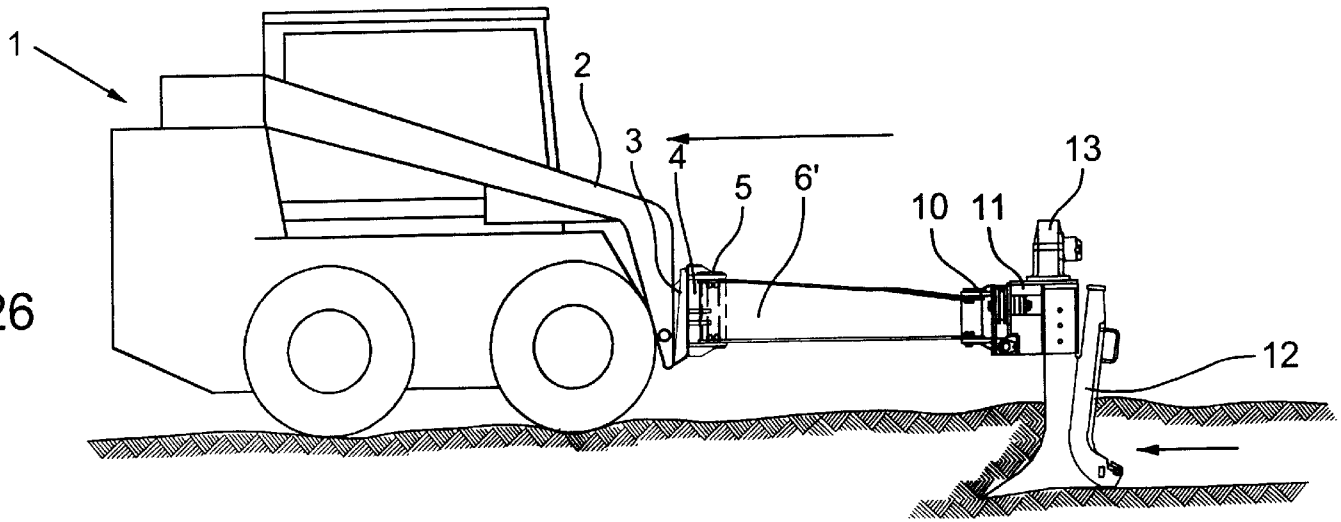
FIG. 26 is a side view of the vehicle of FIG. 25.

FIGS. 25 and 26 show the vehicle 1 of FIGS. 1 to 4 with a tool according to the invention being backed up instead of running forwards. Although this operation is not the primary objective of the invention, it is nevertheless possible to use the tool according to the invention in this way too. For instance, the vehicle might have been operated in a forward direction up to an obstacle, and to continue the operation in the opposite direction, all the operator has to do is change direction without disruption of the cable/tube laying operation.

It will be appreciated that the above description relates to the preferred embodiments by way of example only. Many variations on the invention will be obvious to those knowledgeable in the field, and such obvious variations are within the scope of the invention as described and claimed, whether or not expressly described.

What is claimed as the invention is:

1. A plow trenching apparatus comprising:

a vehicle having a raisable boom structure at a front area thereof;

an arm having a proximal end pivotally mounted to said boom structure to extend forwardly and sidewardly relative to said vehicle;

a trenching plow pivotally mounted at a distal end of said arm via a plow pivot means, to extend rearwardly and downwardly therefrom; and a biasing means mounted between said arm and said boom structure, said biasing means being extendable and retractable to thereby control the position of said trenching plow relative to said vehicle.

2. The plow trenching apparatus as recited in claim 1, wherein said plow is attachable to a tool mount of said boom structure, said arm having an arm mount at said proximal end, said arm mount being attachable to said tool mount via an arm pivot means, said biasing means being attached to said tool mount via a biasing means attachment means and attached to said arm via an arm pivoting attachment arranged on said arm.

3. The plow trenching apparatus as recited in claim 2, wherein said arm is a curved arm.

4. The plow trenching apparatus as recited in claim 3, wherein said arm is a substantially J-shaped curved arm, with the free end of the curved portion of the J forming said distal end.

5. The plow trenching apparatus as recited in claim 4, wherein said curved arm has a first straight part, a second straight part and a third straight part, and said first straight part is arranged at a first angle to said second straight part, and said second straight part is arranged at a second angle to said third straight part, said arm mount being arranged at a free end of said first straight part and said plow being arranged at a free end of said third straight part.

6. The plow trenching apparatus as recited in claim 3, wherein said arm mount mounts to said tool mount via a tool mount coupler, and said biasing means attachment means is arranged on said tool mount coupler.

7. The plow trenching apparatus as recited in claim 3, wherein said plow is held by a plow holder attachable to said distal end, said plow holder permitting said plow to pivot horizontally.

8. The plow trending apparatus as recited in claim 7, wherein said plow holder comprises a plow pivot means attachable to said plow holder for permitting the plow holder to pivot horizontally, and a plow mounting means attachable to said plow pivot means, and said plow being attachable to said plow mounting means.

9. The plow trenching apparatus as recited in claim 3, wherein a vibration means is attachable to said plow, to provide ground penetration enhancing vibrations to said plow.

10. The plow trenching apparatus as recited in claim 9, wherein an elastic element is arranged between said plow pivot means and said distal end of said arm, to dampen vibrations travelling from said plow to said arm.

11. The plow trenching apparatus as recited in claim 9, wherein an elastic element is arranged between said arm mount and said tool mount, to dampen vibrations travelling from said plow to said arm.

* * * * *